United States Patent [19]

Holton

[11] Patent Number: 4,658,735

[45] Date of Patent: Apr. 21, 1987

[54] FOLDING TABLE

[75] Inventor: Lawrence C. Holton, Green Bay, Wis.

[73] Assignee: Krueger, Inc., Green Bay, Wis.

[21] Appl. No.: 874,642

[22] Filed: Jun. 16, 1986

[51] Int. Cl.[4] ..... A47B 3/00

[52] U.S. Cl. ..... 108/131; 108/132

[58] Field of Search ..... 108/129, 131, 132, 130, 108/133; 248/188.6

[56] References Cited

U.S. PATENT DOCUMENTS

| | | | |
|---|---|---|---|
| 441,569 | 11/1890 | Ladd | 108/132 X |
| 1,510,171 | 9/1924 | Heard | 108/129 |
| 1,669,799 | 5/1928 | Wurdack | 108/132 |
| 2,075,778 | 3/1937 | Johannsen | 108/129 |
| 2,666,683 | 1/1954 | Pucci | 108/131 |
| 4,064,815 | 12/1977 | Baum | 108/129 |
| 4,444,124 | 4/1984 | Burr | 108/131 |

FOREIGN PATENT DOCUMENTS

| | | | |
|---|---|---|---|
| 2324921 | 5/1974 | Fed. Rep. of Germany | 108/132 |

*Primary Examiner*—Peter A. Aschenbrenner

*Attorney, Agent, or Firm*—Fuller, Puerner & Hohenfeldt

[57] ABSTRACT

A heavy duty folding table has a pair of pedestal legs, the upper ends of each leg being pivotally joined to a pair of links. The links in turn are pivotally mounted to the table frame. To each leg is attached a T-shaped brace. The leg portion of the brace is pivotally connected to a pedestal leg. The cross pieces of the braces extend between the table frame and are pivotally attached thereto. The two pedestal legs are independently foldable and unfoldable by one person. When in the folded condition, the T-shaped braces lie parallel to and between the table top and pedestal legs.

4 Claims, 7 Drawing Figures

FOLDING TABLE

BACKGROUND OF THE INVENTION

1. Field of the Invention

This invention pertains to folding furniture, and more particularly to tables having legs that fold compactly against the table top.

2. Description of the Prior Art

Folding tables are well known and widely used. Their popularity can be attributed to the relative ease with which they can be handled and stored when in the folded condition. A particularly desirable type of folding table is the type wherein the folded legs lie parallel to the table top. U.S. Pat. No. 4,444,124 discloses a foldable trestle type table in which the folded legs are parallel to the table top. The table legs are pivotally connected to opposite ends of a trestle bar. The legs are further pivotally connected for engagement with the table frame by means of pivotable arms. A major disadvantage of the table of the U.S. Pat. No. 4,444,124 is that both legs must be rotated together into and out of engagement with the table frame when folding or unfolding the table. Because of the spread between the legs, folding and unfolding is very difficult to accomplish by one person; for practical reasons two persons are normally required to operate the table.

Other designs of folding tables in which the folded legs lie parallel to the table top are disclosed in U.S. Pat. Nos. 441,569; 1,510,171; and 2,075,778; and in German Offenlegungsschrift No. 23 24 921. The tables shown in the foregoing patents suffer from the handicap of having relatively weak and compliant leg connections, and thus are suitable only for light duty. That is because a separate leg brace is used with each table leg. Short connecting elements having minimal structural ability to resist wear, bending, and loosening with repeated use are employed to pivotally connect the individual braces and legs. Such tables are not satisfactory for commercial or institutional use.

Thus, a need exists for a heavy duty folding table having legs that fold compactly against the table top and that is easily operable by one person.

SUMMARY OF THE INVENTION

In accordance with the present invention, a commercial quality folding table is provided that is easily folded and unfolded by one person. This is accomplished by apparatus that includes a pedestal-type leg at each end of the table and a heavy duty brace for pivotally connecting each pedestal leg to the table frame.

Each pedestal leg includes a horizontal member that extends laterally between a pair of table frame beams. Each end of the horizontal member is pivotally connected to the first end of a link. The links, in turn, are pivotally connected at their second ends to the ends of the table frame by a shoulder screw. The table frame is preferably notched to permit the shoulder screw to engage and be guided by the table frame when the table is in the unfolded condition. Depending from each leg horizontal member is a vertical pedestal that terminates in a lower horizontal member. The vertical pedestal of each leg is pivotally connected to the leg end of a T-shaped brace. The cross pieces of the T-shaped braces extend laterally between the table frame beams. Rigid and rotational connections are provided between the cross pieces and the table frame. The long transverse spread of the brace cross pieces enables the rotational connections between the braces and the table frame to resist bending moments produced by multi-directional forces applied to the table legs. That construction assures adequate strength and rigidity required for extended heavy duty use.

Because each pedestal leg is connected to the table frame by an individual brace, the brace associated with each leg are engageable with and disengageable from the table frame independently of the brace associated with the other pedestal leg. That construction enables one person to fold and unfold the table with ease. The folding table of the present invention further includes latch means for locking the legs in the unfolded condition. For safety reasons, the latch must be manually released before the legs can be folded.

Other objects and advantages of the present invention will become apparent from reading the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 2:
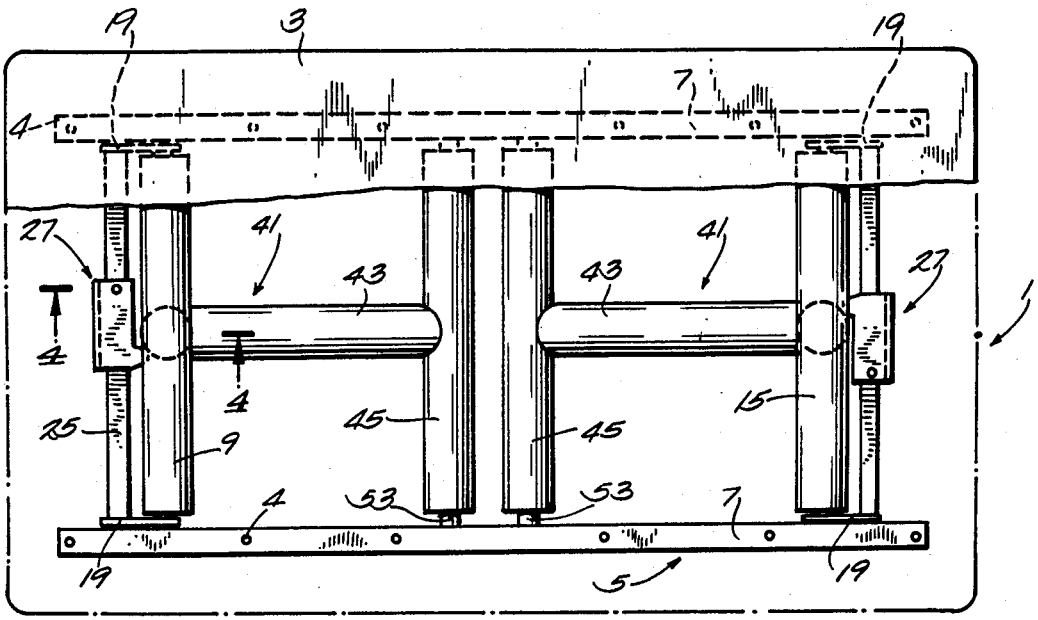
FIG. 2 is a partially broken top view of the folding table of the present invention showing it in the unfolded condition.
Figure 1:
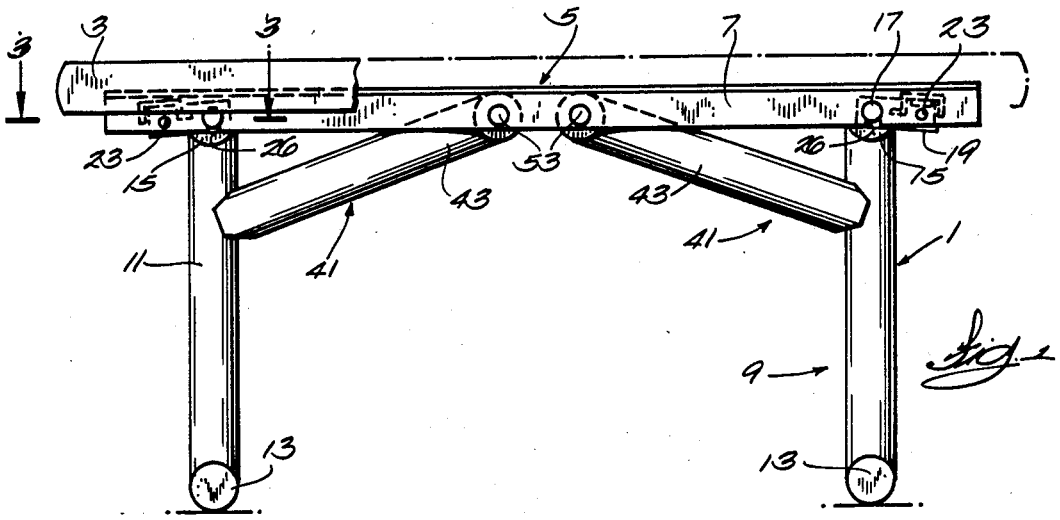
FIG. 1 is a partially broken side view of the folding table of the present invention showing it in the unfolded condition.

Referring to FIGS. 1 and 2, a folding table 1 is illustrated that includes the present invention. The folding table 1 includes a top 3 that may be of any suitable material such as wood, plastic, or metal. To the underside of the top 3 is firmly attached, as by conventional fasteners 4, a rigid table frame 5. In the illustrated construction, the table frame 5 is composed of a pair of longitudinally extending laterally spaced beams 7.

Figure 3:
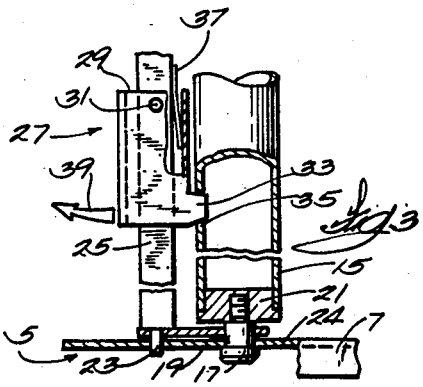
FIG. 3 is a partial cross sectional view taken along lines 3—3 of FIG. 1.

The folding table 1 includes a pair of pedestal type legs 9. In FIGS. 1 and 2, the legs 9 are shown in the unfolded condition. Each leg comprises a vertical pedestal 11, a lower horizontal member 13, and an upper horizontal member 15. The upper horizontal members 15 extend laterally between, and are slightly shorter than the spread between, the beams 7. Pivotally connected to the opposite ends of each upper horizontal member, as by shoulder screws 17, is a link 19. See FIGS. 3 and 4. The shoulder screws 17 may be threaded into caps 21 that are welded or otherwise secured to the ends of the leg upper horizontal members. The second ends of the links 19 are pivotally connected, as by pins 23, to the frame 5 near the ends of the beams 7. Attached to and extending between the pair of links 19 at each end of the table is a cross bar 25. It will be apparent that the links, set screws, cross bar 25, and upper horizontal members can rotate about the pins 23 as a unit. To increase the range of rotation of the foregoing parts, the beams are formed with suitable notches 26 that accept the shoulder portions 24 of the shoulder screws. See FIG. 1. When the shoulder screws are received within the notches 26, the shoulder screws and pins 23 are nearly in horizontal alignment, and the weight of the table top 3 is borne by the legs through the shoulder screws and caps 21.

To prevent undesired rotation of a leg 9, a manual latch mechanism 27 may be employed. See FIGS. 3 and 4. The illustrated latch 27 includes a lever 29 that is pivotally connected at one end thereof to the cross bar 25 by a suitable connector 31. The lever end opposite the connector 31 is manufactured with a tab 33 that engages a slot 35 formed in the upper horizontal member 15. to retain the lever tab 33 in the slot 35, a leaf spring 37 is attached to the cross piece and acts against the lever to bias the tab into the slot. Manually rotating the lever in the direction of arrow 39 overcomes the force of the spring 37 to disengage the tab from the slot and thereby permit rotation of the upper horizontal member.

Figure 4:
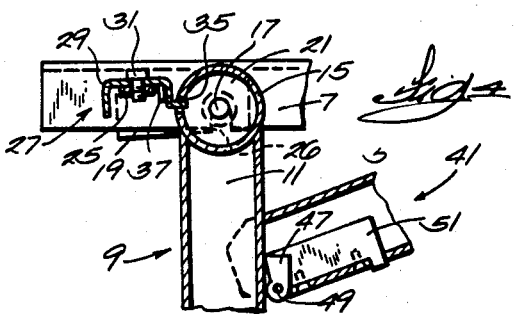
FIG. 4 is a cross sectional view taken along lines 4—4 of FIG. 2.

In accordance with the present invention, a heavy duty brace 41 is pivotally connected between each leg 9 and the table frame 5. As best shown in FIG. 2, each brace 41 is generally T-shaped, comprising a leg portion 43 and a cross piece 45. The free ends of the leg portions 43 may be concavely shaped to conform to the exterior surfaces of the leg vertical pedestals 11. See FIGS. 1 and 4. As best seen in FIG. 4, the pivotal connections between the brace leg portions and the leg vertical pedestals may be accomplished by means of a lug 47 welded to each vertical pedestal, together with a pin 49. A plate 51 welded to the inside of each brace leg portion contains an aperture through which the pin 49 extends to create the pivotal connection. The connection can be as disclosed in U.S. Pat. No. 4,444,124 incorporated herein by reference.

As best seen in FIGS. 1 and 2, the cross piece 45 of each brace 41 is pivotally connected to opposite table frame beams 7 toward the center of the folding table 1 by means of pins 53. The pins 53 may be fairly short, so as to extend only partially into the cross piece. In that case, two pins are required with each cross piece. Alternately, the pins may be in the form of full length rods that extend completely through the cross piece. In either case, the wide spread between the ends of the cross piece greatly reduces the force on the pins from any moment or force applied to the legs 9 or braces. Consequently, the braces provide greatly increased strength and rigidity to the legs of the folding table of the present invention as compared with prior folding tables.

Figure 5:
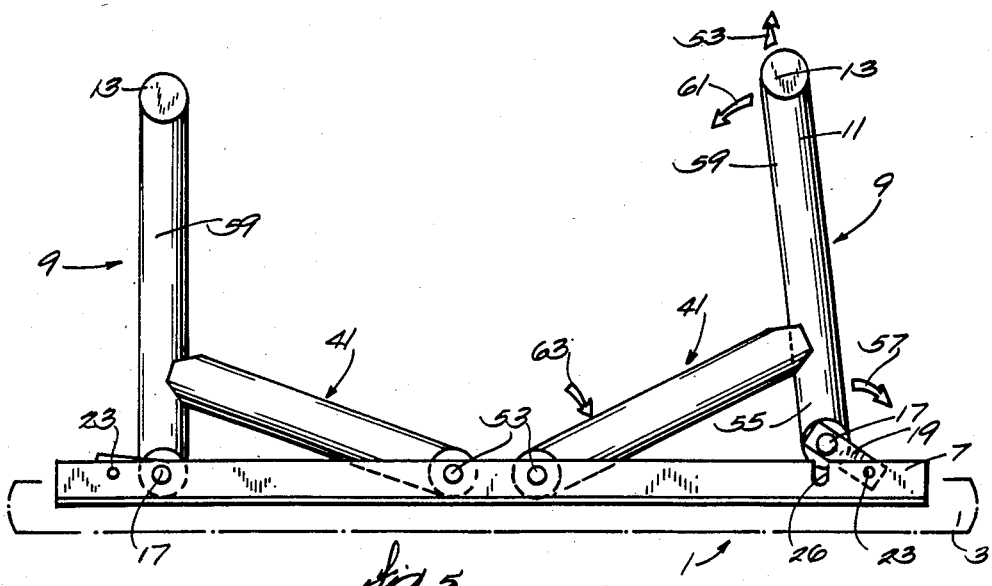
FIG. 5 is a partial side view of the folding table of the present invention turned upside down and showing the initial stages of the folding process.
Figure 6:
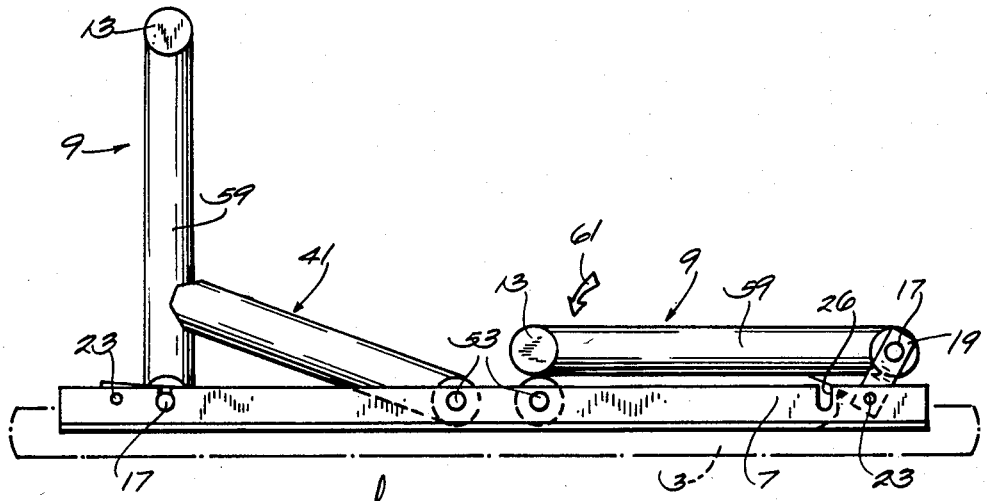
FIG. 6 is a view similar to FIG. 5 but showing one leg in the folded condition.
Figure 7:
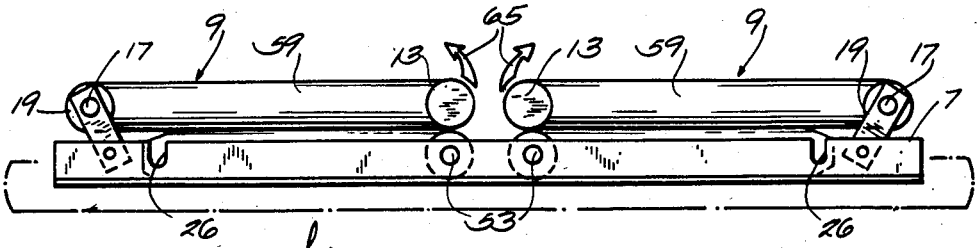
FIG. 7 is a view similar to FIG. 6 but showing both table legs in the folded condition.

To operate the folding table 1 of the present invention, it will be assumed that the table is initially in the unfolded condition. Turning to FIG. 5, the table is first turned upside down. The latch 27 associated with one of the legs 9 is released. Latch release is accomplished by pulling the lever 29 in the direction of arrow 39 against the biasing force of the leaf spring 37, FIGS. 3 and 4. Pulling the lever 29 in the direction of arrow 39 disengages lever tab 33 from the slot 35 in the leg upper horizontal member 15. The leg is then lifted vertically upward, as indicated by arrow 53, FIG. 5, such that set screws 17 become disengaged from the frame notches 26. Such upper leg movement inherently causes the set screws and links 19 to pivot about pins 23, and the upper section 55 of the vertical pedestal 11 rotates in the direction of arrow 57. Simultaneously, the lower section 59 of the vertical pedestal rotates in the direction of arrow 61 about the hinge connection between the vertical pedestal and the brace 41. Continued rotation of the leg in the direction of arrows 57 and 61 causes the brace to rotate in the direction of arrow 63 about the pins 53 until the leg brace attain the completely folded condition of FIG. 6. The second leg is then folded in the identical manner, FIG. 7. In the folded condition, both the legs and the braces lie snugly parallel to the table top 3. To unfold the folded table of FIG. 7, it is necessarily merely to rotate the lower sections 59 of the legs in the direction of arrows 65, and reverse the sequence of steps followed for the folding operation. Because the legs are independently foldable and unfoldable, they may be easily operated by one person.

Thus, it is apparent that there has been provided, in accordance with the invention, a folding table that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A heavy duty table having legs that are operable between folded and unfolded conditions comprising:

a. a table top;

b. a pair of laterally spaced beams attached to the underside of the table top;

c. a pair of pedestal type legs, each leg having an upper horizontal member, a lower horizontal member, and a vertical pedestal connecting the upper and lower horizontal members;

d. a pair of links operatively associated with each pedestal leg, each link having a first end pivotally mounted near the ends of a beam and a second end pivotally attached to the end of a leg upper horizontal member;

e. a pair of T-shaped braces, each brace having a leg portion pivotally connected to a pedestal leg vertical pedestal and a cross piece extending between the table beams; and f. pin means for pivotally connecting each brace cross piece to the beams, so that the T-shaped braces add strength and rigidity to the pedestal legs and the pedestal legs can be independently folded and unfolded.

2. The table of claim 1 wherein the pin means comprises a rod that extends between the table beams and through the brace cross piece for pivotally connecting the brace to the beams.

3. The table of claim 1 wherein the braces lie parallel to and between the pedestal legs and the table top when the legs are in the folded condition.

4. The table of claim 1 wherein the links of the vertical pedestals of the pedestals' legs and the leg portions of the braces are related such that the cross pieces of the braces lie adjacent to the lower horizontal members of the associated pedestal leg and the brace cross pieces lie between the associated lower horizontal member and table top when the pedestal legs are in the folded condition.

* * * * *